United States Patent [19]

Stoltman

[11] Patent Number: 4,640,248

[45] Date of Patent: Feb. 3, 1987

[54] FAILSAFE DRIVE-BY-WIRE ENGINE CONTROLLER

[75] Inventor: Donald D. Stoltman, Henrietta, N.Y.

[73] Assignee: General Motors Corporation, Detroit, Mich.

[21] Appl. No.: 812,901

[22] Filed: Dec. 23, 1985

[51] Int. Cl.[4] ..... F02D 11/10; F02D 41/22

[52] U.S. Cl. ..... 423/399; 123/179

[58] Field of Search ..... 123/359, 361, 399, 479

[56] References Cited

U.S. PATENT DOCUMENTS

| | | | |
|---|---|---|---|
| 4,393,833 | 7/1983 | Mann et al. | 123/335 |
| 4,488,527 | 12/1984 | Pfalzgraf et al. | 123/399 |
| 4,491,112 | 1/1985 | Kanegae et al. | 123/479 |
| 4,519,360 | 5/1985 | Murakami | 123/399 |

*Primary Examiner*—William A. Cuchlinski, Jr.

*Attorney, Agent, or Firm*—Howard N. Conkey

[57] ABSTRACT

A drive-by-wire engine control system in which the engine is set to an idle operating mode when the force applied to the accelerator pedal is zero even though the accelerator pedal is in an off-idle position.

2 Claims, 3 Drawing Figures

FAILSAFE DRIVE-BY-WIRE ENGINE CONTROLLER

This invention relates to an engine controller and particularly to a failsafe drive-by-wire engine controller.

Vehicle engine control systems that do not require a mechanical connection between the operator actuated accelerator pedal and the engine are known. These systems typically monitor the position of the accelerator pedal such as by a variable resistance potentiometer. In one form of these systems, the throttle blade in the intake of the engine is positioned by an electric actuator to a position dependent on the accelerator pedal position to control mass air flow into the engine and fuel is metered to the engine based on air flow to achieve a desired air/fuel ratio. In another form of these systems, the fuel delivered to the engine is metered dependent on the accelerator pedal position and the throttle blade is positioned by an electric actuator to control mass air flow into the engine based on fuel flow to achieve the desired air/fuel ratio.

In the absence of a mechanical connection between the accelerator pedal and the throttle blade in the foregoing systems, it has been suggested to provide for failsafe operation in the event the throttle blade should stick in an open position. This was accomplished by comparing the position of the throttle blade with the position of the accelerator pedal. If the throttle blade remains in an open position for a predetermined time period after the accelerator pedal is returned to an idle position calling for a closed throttle blade, remedial action such as engine shutdown or closure of the throttle via the throttle actuator is taken.

While this system provides for failsafe operation in the event the throttle blade is stuck in an open position, it does not provide for failsafe operation in the event the accelerator pedal should stick in an off-idle position. For example, if the accelerator pedal should stick in an off-idle position, the above described drive-by-wire control systems would typically result in an open throttle blade corresponding to the stuck position of the accelerator pedal. Since there is no error between the position of the accelerator pedal and the throttle blade, no remedial action would be taken by the aforementioned system.

In accord with this invention, a condition that represents an operator commanded engine idle operating mode is sensed independent of the position of the accelerator pedal and an idle operating mode of the engine is established in response thereto. The condition representing an operator commanded idle operating mode is sensed by monitoring the force applied to the accelerator pedal by the vehicle operator. If the force applied to the accelerator pedal is zero, the engine operation is forced to an idle operating mode independent of the position of the accelerator pedal.

The invention may be best understood by reference to the following description of a preferred embodiment and the drawings in which.

Figure 1:
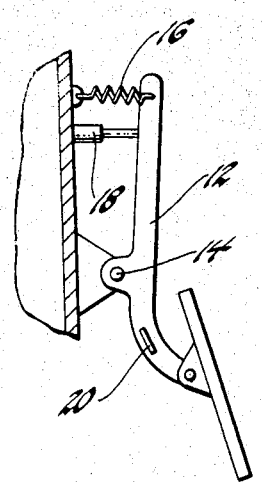
FIG. 1 is a schematic diagram of a vehicle accelerator pedal in a vehicle drive-by-wire system incorporating the principles of this invention.
Figure 2:
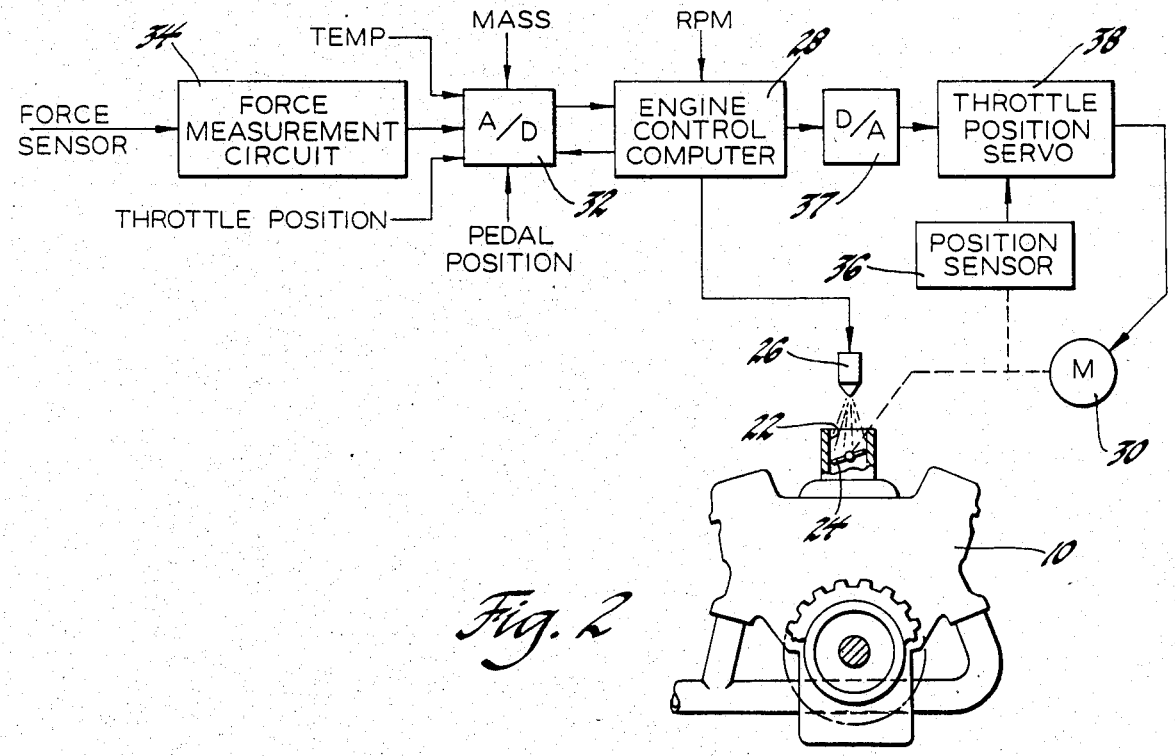
FIG. 2 is a diagram of a vehicle engine and controller incorporating the principles of this invention.

Referring to FIGS. 1 and 2, an internal combustion engine 10 is controlled by a vehicle operator by application of force to an accelerator pedal 12 tending to rotate the pedal 12 about a pivot 14 to an off-idle position in opposition to a return force exerted by a spring 16 tending to rotate the pedal 12 to an engine idle position. The pedal 12 rotates from its engine idle position to an off-idle position that is dependent upon the magnitude of the vehicle operator applied force opposing the force of the spring 16.

The position of the pedal 12 is used by an engine controller illustrated in FIG. 2 to adjust the cylinder charge of the engine 10. In one embodiment, the position of the pedal 12 represents a desired fuel injection amount. In this case, the engine controller controls engine fuel injectors to inject the desired amount and adjusts the mass air flow into the engine to achieve a desired air/fuel ratio. In another embodiment, the position of the pedal 12 represents a desired mass air flow amount. In this case, the engine controller adjusts the mass air flow into the engine to equal the desired flow and controls the quantity of fuel injected into the engine 10 to achieve the desired air/fuel ratio.

To provide a measure of the position of the pedal 12 representing the operator input command, a linear potentiometer 18 is positioned so as to be actuated by rotation of the pedal 12 about the pivot 14. The output of the potentiometer 18 is utilized in the engine controller of FIG. 2 to control the air and fuel input to the engine 10. In addition, a force sensor 20, which may take the form of a resistive strain gauge, is carried by the pedal 12 so as to provide an output that is a measure of the force applied to the pedal 12 by the vehicle operator in opposition to the spring force on the pedal 12 by the spring 16.

Referring to FIG. 2, air and fuel are drawn into the engine 10 through a throttle bore 22 having a throttle blade 24 positioned therein to control the air flow into the engine 10. Fuel is injected into the throttle bore 22 at a position above the throttle blade 24 via a fuel injector 26. In this embodiment, the quantity of fuel injected by the fuel injector 26 is commanded by the accelerator pedal 12 and the throttle blade 24 is positioned to control the air flow into the engine to achieve a desired air/fuel ratio.

The control of the fuel injector 26 and the throttle blade 24 is accomplished by an engine controller the primary element of which is an engine control computer 28 in the form of a digital microprocessor having an operating program stored therein whose step-by-step execution controls the fuel injector 26 and positions the throttle blade 24 in accord with the principles of this invention.

In general, the computer 28 issues timed pulses to the fuel injector 26 to inject fuel into the engine 10 based on the position of the accelerator pedal 12 and controls the position of the throttle blade 24 via a servo motor 30 to achieve the air flow producing the desired air/fuel ratio. The computer 28 is a conventional automotive computer including memories, a central processing unit, input/output circuits and a clock and may be programmed by the exercise of skill in the art.

The measurements of various analog signals are provided to the computer 28 via an analog-to-digital circuit 32. These signals include the output of the linear potentiometer 18 representing the position of the pedal 12, the output of a conventional mass air flow sensor (not illustrated) measuring the mass air flow into the engine 10, the output of a force measurement circuit 34 representing the force sensed by the force sensor 20, an engine coolant temperature signal provided by a conventional temperature sensor exposed to the engine coolant and an analog signal representing the position of the throttle blade 24 provided by a position sensor 36. The position sensor 36 may take the form of a potentiometer driven by the output shaft of the servo motor 30 and whose output is representative of the angular position of the throttle blade 24. The various analog signals are converted to digital signals by the analog-to-digital converter 32 upon command of the engine control computer 28. The digital values are stored in a random access memory in the computer 28 for use in controlling the fuel injector 26 and for controlling the position of the throttle blade 24. The engine control computer 28 further receives a pulse input representing the engine rpm from a conventional ignition distributor. These pulses are provided once each intake event and function to initiate operation of the injector 26 which provides a pulse of fuel for each intake event of the engine 10.

The output of the engine control computer 28 is a timed pulse to the fuel injector 26 having a width calculated to provide the quantity of fuel commanded by the position of the accelerator pedal 12. Additionally, the computer 28 provides a digital signal to a digital-to-analog converter 37 representing a commanded throttle blade position determined to produce a desired mass air flow into the engine resulting in a desired air/fuel ratio. The output of the digital-to-analog converter 37 is provided to a throttle position servo 38. The servo 38 responds to the commanded throttle position provided via the digital-to-analog circuit 37 and the actual position of the throttle 24 provided by the position sensor 36 to supply a signal to the servo motor 30 to position the throttle blade 24 to achieve the commanded throttle position.

Figure 3:
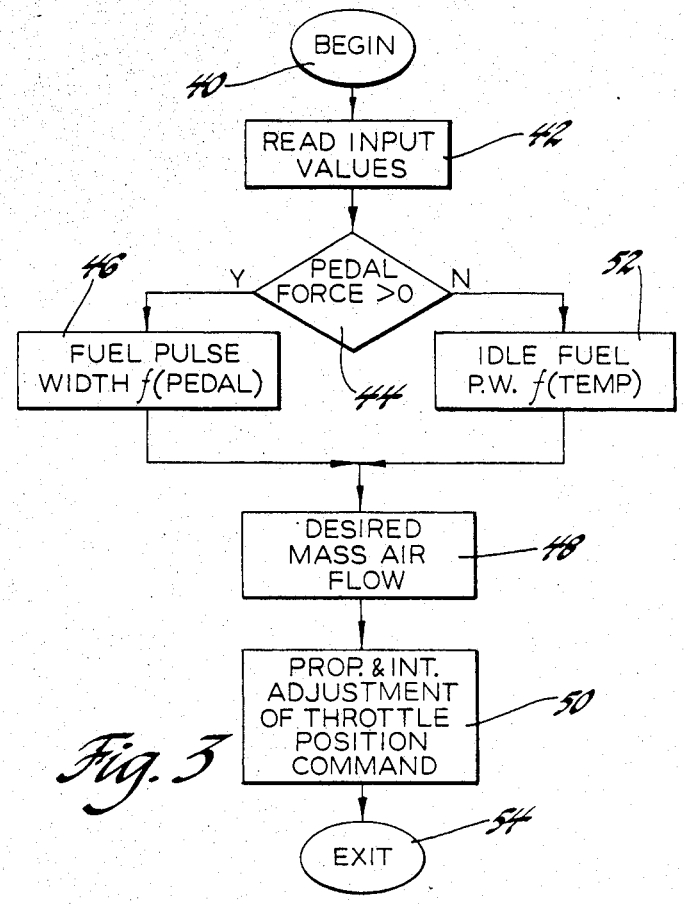
FIG. 3 is a computer flow diagram illustrating the operation of the controller of FIG. 2 in carrying out the principles of this invention.

The operation of the engine control computer 28 for controlling the injector 26 and for positioning the throttle blade 24 and for providing failsafe operation in accord with this invention is illustrated in FIG. 3. The flow diagram of FIG. 3 represents the operation of the engine control computer 28 and is implemented in the form of an operating program stored in memory.

The program begins at step 40 and proceeds to a step 42 where the computer reads and stores the various input values. At this step, the analog inputs to the analog-to-digital circuit 32 are sequentially read and stored in memory locations in the control computer 28. Thereafter, the program proceeds to a step 44 where the magnitude of the pedal force sensed by the sensor 20 and stored at step 42 is compared to zero. If the force is greater than zero indicating the operator is applying force to the pedal to command a desired off-idle fuel flow, the program proceeds to a step 46 where the fuel pulse width to be injected with each intake event of the engine 10 in order to achieve the commanded fuel flow represented by the output of the throttle position sensor 18 is determined. This pulse width is set into an output counter in the engine control computer 28 and issued with each rpm signal corresponding to each intake event.

From step 46, the program proceeds to a step 48 where the mass air flow required to produce a desired air/fuel ratio is determined. From this step, the program proceeds to a step 50 where the output to the digital-to-analog converter 37 representing a commanded throttle position is adjusted in accord with the difference between the actual air flow from the mass air sensor measured at step 42 and the desired mass air flow determined at step 48. This signal may be adjusted in accord with proportional and integral terms so as to precisely obtain the desired air/fuel ratio. The throttle position servo 38 responds to this commanded signal to position the throttle blade 24 via the servo motor 30 and the feedback signal from the position sensor 36 to achieve a commanded desired mass air flow into the engine 10.

Returning again to step 44, if it is determined that the pedal force is zero indicating that the operator is not applying any force to the accelerator pedal 12 and is thereby commanding idle fuel, the program bypasses the step 46 and proceeds to a step 52 where the fuel input to the engine 10 is controlled in accord with the engine idle fuel schedule. At this step, the engine is controlled to an idle speed based upon a fuel pulse width obtained from an idle speed fuel pulse lookup table stored in memory as a function of engine temperature. As can be seen, this pulse width to achieve an idle fuel delivery is provided even though the linear potentiometer 18 may output a signal representing an off-idle fuel command.

After determining the idle fuel pulse width at step 52, the program proceeds to the step 48 where the mass air/fuel required to produce the desired air flow ratio based upon the idle fuel pulse width determined at step 52 is determined. From step 48, the program then proceeds to 50 whereby the throttle blade 24 is positioned as previously described to achieve the desired mass air flow. From step 50, the program exits the routine at 54.

The operation of the computer as illustrated by the flow charts of FIG. 3 provides for a failsafe operation of the engine 10 even though the accelerator pedal may be stuck in a position at which the linear potentiometer 18 indicates a commanded fuel pulse width greater than idle even though the operator is not applying force to the pedal 12. This is accomplished by bypassing the normal fuel control routine executed at step 46 when the force on the pedal as sensed by the sensor 20 indicates the vehicle operator is not applying any force to the pedal 12 thereby commanding an engine idle condition.

The foregoing description of a preferred embodiment for the purpose of illustrating the invention is not to be considered as limiting or restricting the invention since many modifications may be made by the exercise of skill in the art without departing from the scope of the invention.

The embodiments of the invention in which an exclusive property or privilege is claimed are defined as follows:

1. A control system for a vehicle internal combustion engine having an intake space into which air and fuel are supplied, comprising in combination:

an accelerator pedal biased to an engine idle position and operable to an engine off-idle position in response to a force applied thereto;

position sensing means for sensing the position of the accelerator pedal;

force sensing means for sensing the force applied to the accelerator pedal; and means responsive to the force applied to the accelerator pedal sensed by the force sensing means for supplying an air and fuel mixture to the engine in accord with the accelerator pedal position sensed by the position sensing means when the force applied to the accelerator pedal is greater than zero and in accord with an engine idle schedule when the force applied to the accelerator pedal is zero, whereby the engine operation is maintained at idle when the force applied to the accelerator pedal is zero even though the accelerator pedal position remains in an off-idle position.

2. A control system for a vehicle internal combustion engine having an intake space into which air and fuel are supplied, comprising in combination:

an accelerator pedal biased to an engine idle position and operable to an engine off-idle position in response to a force applied thereto;

position sensing means for sensing the position of the accelerator pedal;

force sensing means for sensing the force applied to the accelerator pedal;

fuel supply means responsive to the force applied to the accelerator pedal sensed by the force sensing means for (A) supplying a fuel to the intake space in accord with the accelerator pedal position sensed by the position sensing means when the force applied to the accelerator pedal is greater than zero and (B) supplying an idle fuel quantity to the intake space when the force applied to the accelerator pedal is zero;

air supply means including a variable position throttle operable to regulate the air flow into the engine intake space; and means responsive to the fuel supplied to the intake space for positioning the throttle to a position at which the air flow into the intake space results in a desired air and fuel ratio, whereby the engine operation is maintained at idle when the force applied to the accelerator pedal is zero even though the accelerator pedal position remains in an off-idle position.

* * * * *